US008616223B2

(12) United States Patent
Rabe et al.

(10) Patent No.: US 8,616,223 B2
(45) Date of Patent: Dec. 31, 2013

(54) METHODS AND APPARATUSES FOR APPLYING EYELASH EXTENSIONS

(75) Inventors: Thomas Elliot Rabe, Baltimore, MD (US); Peter Jonathan Wyatt, Forest Hill, MD (US); Keri Ann Marsh, Baltimore, MD (US); Matthew Clair Ehrman, Pikesville, MD (US); Nancy Taylor Dempsey, Forest Hill, MD (US); Megan Mai Morys, Cambridge (GB); Robert Scadding Moir, Cambridge (GB); Peter Paul Beentje, Rotterdam (NL); Kate Reeves, Berkshire (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/208,624

(22) Filed: Aug. 12, 2011

(65) Prior Publication Data

US 2011/0290271 A1 Dec. 1, 2011

Related U.S. Application Data

(63) Continuation of application No. 12/245,384, filed on Oct. 3, 2008, now Pat. No. 8,015,980.

(60) Provisional application No. 60/999,625, filed on Oct. 19, 2007.

(51) Int. Cl.

| | |
|---|---|
| ***A45D 40/30*** | (2006.01) |
| ***A45D 7/02*** | (2006.01) |
| ***A45D 8/18*** | (2006.01) |
| ***A45D 40/26*** | (2006.01) |
| ***A41G 3/00*** | (2006.01) |
| ***A41G 5/00*** | (2006.01) |

(52) U.S. Cl.
USPC ..... 132/216; 132/212; 132/218; 132/201; 132/320

(58) Field of Classification Search
USPC ..... 132/201, 216, 217, 212, 218, 53–56, 132/317, 319, 320; D28/36, 7, 99; 81/487, 81/349, 354, 443, 142; 24/72.1, 457, 489, 24/532, 30.5 L; 401/128, 130, 261; 623/15.11; 383/61.3, 64, 69
See application file for complete search history.

(56) References Cited

U.S. PATENT DOCUMENTS

| | | | |
|---|---|---|---|
| 1,450,259 | A | 4/1923 | Nessler |
| 1,831,801 | A | 11/1931 | Birk |

(Continued)

FOREIGN PATENT DOCUMENTS

| | | |
|---|---|---|
| GB | 459930 | 1/1937 |
| GB | 526272 | 9/1940 |

(Continued)

OTHER PUBLICATIONS

PCT International Search Report, date mailed: Apr. 2, 2009, 4 pages.

*Primary Examiner* — Vanitha Elgart
(74) *Attorney, Agent, or Firm* — Charles R. Ware; John G. Powell

(57) ABSTRACT

An applicator for use with an eyelash extension system that has a backbone and a backbone surface configured to be joined with a closure surface. A plurality of eyelash extensions are attached to the backbone. The applicator includes a frame having a first end and a second end spaced laterally from the first end, a rail attached to the frame and extending laterally between the first and second ends, and a cam. The cam has a cam surface configured to contact the backbone of the eyelash extension system to urge the backbone to come into contact with the closure as the cam is moved laterally along the rail.

14 Claims, 6 Drawing Sheets

(56) References Cited

U.S. PATENT DOCUMENTS

| | | | |
|---|---|---|---|
| 1,960,687 | A | 5/1934 | Wills |
| 2,079,256 | A | 12/1936 | Kaiser |
| 2,324,271 | A | 7/1943 | Adler |
| 2,667,176 | A | 1/1954 | Lund |
| 2,760,264 | A | 8/1956 | Javits |
| 2,812,768 | A | 11/1957 | Giuliano |
| 2,835,259 | A | 5/1958 | Bertrand |
| 3,032,042 | A | 5/1962 | Borg |
| 3,266,500 | A | 8/1966 | Weld |
| 3,447,540 | A | 6/1969 | Osher |
| 3,461,886 | A | 8/1969 | Bau |
| 3,478,754 | A | 11/1969 | Martin, Jr. |
| 3,516,422 | A | 6/1970 | Bechtold et al. |
| 3,547,135 | A | 12/1970 | Roos |
| 3,556,113 | A | 1/1971 | Frieder |
| 3,559,657 | A | 2/1971 | Bau |
| 3,561,454 | A | 2/1971 | O'Connell |
| 3,670,742 | A | 6/1972 | Weaner |
| 3,722,519 | A | 3/1973 | Epstein |
| 3,828,803 | A | 8/1974 | Windsor |
| 3,900,038 | A | 8/1975 | Masters |
| 4,135,527 | A | 1/1979 | Montiel |
| 5,547,529 | A | 8/1996 | Woolf |
| 6,029,674 | A | 2/2000 | Han |
| 6,105,585 | A | 8/2000 | Thomas |
| 2002/0056465 | A1 | 5/2002 | Shin |
| 2003/0005941 | A1 | 1/2003 | Iosilevich |
| 2009/0217938 | A1 | 9/2009 | Rabe et al. |

FOREIGN PATENT DOCUMENTS

| | | |
|---|---|---|
| GB | 621278 | 4/1949 |
| GB | 738832 | 10/1955 |
| GB | 921662 | 3/1963 |
| GB | 924631 | 4/1963 |
| GB | 1021063 | 2/1966 |
| GB | 1189251 | 4/1970 |
| GB | 1591975 | 7/1981 |
| JP | 10183415 | 7/1988 |
| JP | 2000027018 | 1/2000 |
| JP | 2002300918 | 10/2002 |
| JP | 2006113302 | 4/2006 |
| KR | 10-2004-0021201 | 5/2005 |
| WO | WO 00/30482 | 6/2000 |

METHODS AND APPARATUSES FOR APPLYING EYELASH EXTENSIONS

CROSS REFERENCE TO RELATED APPLICATION

This application is a continuation of U.S. application Ser. No. 12/245,384, filed on Oct. 3, 2008, now U.S. Pat. No. 8,015,980 which claims the benefit of U.S. Provisional Application No. 60/999,625, filed Oct. 19, 2007.

FIELD OF THE INVENTION

The present disclosure relates to the application of eyelash extensions, and in particular to apparatuses for applying a plurality of eyelash extensions as a group.

BACKGROUND OF THE INVENTION

Many people are dissatisfied with the look of their eyelashes. They would prefer lashes with better curl, color, fullness, length, etc. While cosmetic products, such as mascara, are available to improve these characteristics, certain people still would prefer even greater enhancements than are possible through their use of mascara alone.

False eyelashes have been around and in use for quite some time. False eyelashes are applied to the eyelid, and may improve the appearance of the wearer by making it appear that the wearer has eyelashes of greater curl, color, fullness, length, etc. However, false eyelashes also may make it appear that the user has more than one set of eyelashes if the application is not performed with a high degree of precision. Obtaining this degree of precision is a difficult task even for an experienced user.

Alternatively, one may try eyelash extensions. Unlike false eyelashes, eyelash extensions are applied directly to the eyelash, instead of to the eyelid. As a consequence, it does not appear as though the user has more than one set of eyelashes, but rather longer, curvier, darker, fuller, etc. eyelashes. There are drawbacks with this solution as well. At the present time, eyelash extensions are applied one by one to the existing eyelashes. As a consequence, the process is labor intensive, requires highly skilled application, and is expensive. Because the process is not easily amenable to self-application, the extensions are most commonly applied in the salon setting, and as the eyelashes fall out, repeated "maintenance" visits may be required. Also, because eyelash extensions are applied to existing eyelashes using a one-to-one ratio, if one has problems with eyelash count, extensions do little to improve the matter.

SUMMARY OF THE INVENTION

In one embodiment, an applicator for use with an eyelash extension system comprises a backbone having a backbone surface, a plurality of eyelash extensions attached to the backbone and depending therefrom, a closure having a closure surface facing the backbone surface and configured to be joined thereto, the applicator comprising: a frame having a first end and a second end spaced laterally from the first end; a rail attached to the frame and extending laterally between the first and second ends; and a cam comprising a cam surface, the cam surface being configured to contact the backbone when the applicator is used with the eyelash extension system, the cam being movably joined to the rail such that the cam can be moved along the rail from the first end to the second end thereby causing the cam surface to urge the backbone to come into contact with the closure.

In another embodiment, an applicator for use with an eyelash extension system comprising a backbone having first and second backbone ends and a backbone surface extending between the first and second backbone ends, a plurality of eyelash extensions attached to the backbone and depending therefrom, and a closure having first and second closure ends and a closure surface extending between the first and second closure ends, wherein the first closure end is attached to the first backbone end, and the second closure end is not attached to the second backbone end, the applicator comprising: a frame having a holder configured to hold the eyelash extension system, wherein the holder has a first holder end and a second holder end spaced laterally therefrom; and a wedge moveably mounted to the frame and configured to separate the backbone from the closure as the wedge moves.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

The term "attached" refers to elements being connected or united by adhering, fastening, bonding, etc. by any method suitable for the elements being attached together. Many suitable methods for attaching elements together are well-known, including adhesive bonding, mechanical fastening, etc. Such attachment methods may be used to attach elements together over a particular area either continuously or intermittently.

The term "coupled" refers to configurations whereby an element is directly secured to another element by attaching the element directly to the other element, and to configurations whereby an element is indirectly secured to another element by attaching the element to intermediate member(s) that is(are) in turn attached to the other element.

The term "disposed" is used to mean that an element(s) exists in a particular place or position as a unitary structure with other elements or as a separate element coupled to other elements.

The term "effective diameter" refers to a measurement related to a cross-section. In regard to a circular cross-section, the effective diameter is the diameter of the cross-section. For non-circular cross-sections, the effective diameter may be more difficult to describe. However, one manner in which the effective diameter may be calculated is as the square root of four times the cross-sectional area divided by pi.

These terms may be defined with additional language in the remaining portions of the specification.

Certain of the figures illustrate different eyelash extension systems, while other figures illustrate different applicators for applying the eyelash extensions, which applicators may be operable with one or more of the eyelash extension systems illustrated. An attempt has been made to number similar parts in a similar fashion, although strict adherence to such a system is not always possible in practice. Moreover, it will be recognized that while the presentation may discuss particular attributes of these systems and applicators in regard to a particular system or applicator, much of the discussion relative to one system is applicable to the other systems, and discussion relative to one applicator or its method of use is applicable to the other applicators and their methods of use.

Figure 1:
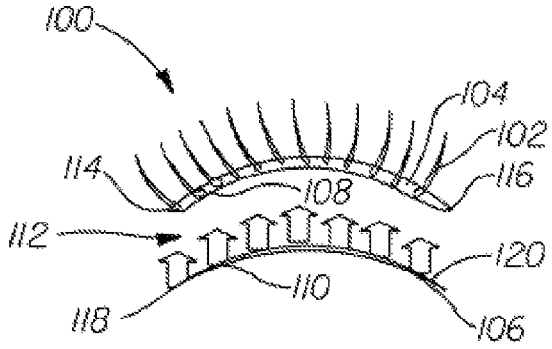
FIG. 1 is a perspective view of an eyelash extension system to be applied to a set of eyelashes.

To begin then, FIG. 1 illustrates an eyelash extension system 100 including a plurality of eyelash extensions 102 attached to a backbone 104 and depending therefrom. The system 100 also includes a closure 106. The backbone 104 has a backbone surface 108, and the closure 106 has a closure surface 110. The closure 106 has a first state, as illustrated, wherein at least a part of the closure surface 110 is spaced from the backbone surface 108. As illustrated, the entire closure surface 110 is spaced from the backbone surface 108. The closure 106 also has a second state wherein the part of the closure surface 110 abuts the backbone surface 108 (see FIGS. 2, 3B).

It will be recognized that if a set of eyelashes is placed in the space 112 defined between the backbone surface 108 and the closure surface 110 with the closure 106 in the first state, at least some of the eyelashes will be disposed between the surfaces 108, 110 when the closure 106 is moved from the first state to the second state. The eyelashes disposed between the surfaces 108, 110 may be held therebetween by a variety of different attachment mechanisms. The nature of the attachment between the surfaces 108, 110 may limit the ability to remove the eyelashes from between the surfaces 108, 110, as may the interaction of the eyelashes with either or both of the surfaces 108, 110.

It will be appreciated that there is considerable diversity in the structure and composition of the eyelash extensions 102, the backbone 104, the closure 106, the mechanism used to attach the extensions 102 to the backbone 104, and the mechanism used to attach the system 100, or a part thereof, to the user's eyelashes. The following is a partial listing of the potential variations in regard to the extensions 102, the backbone 104, the closure 106 and attachment mechanisms. This listing is intended to be exemplary and non-limiting. Furthermore, much of this discussion will be generally applicable to the other eyelash extension systems described below.

In regard to the extensions 102, the extensions 102 may be made from biomaterials from animals, including humans, or plants (e.g. cotton). In particular, the extensions 102 may be made from keratinous material from an animal, such as eyelashes, although hair, fur, feathers, wool and silk may be used as well. The extensions 102 may also be made of synthetic materials, including nylon, polyester, and the like. In particular, synthetic fibers may be particularly well suited for use in the system 100. Also, the extensions 102 may be made of composite materials, which provide opportunities to use core/shell or layered cross-sectional designs to give the extensions 102 unique properties. This approach allows for separation of functionality. For example, one material of the composite can be chosen for its structural properties, and additional materials of the composite may be chosen for desirable phase transition, electromagnetic, surface energy, light refractivity, or other value-added properties.

The shape, color, effective diameter, length, curvature, and density of the extensions 102 may vary. The variation may be between extensions included in one system and those included in another system. However, the variations may be between individual extensions included in one particular system, or even within one individual lash extension in one particular system. For example, multiple lengths may be used in one item of a particular system, for example.

As to the shape, the extensions 102 may have a generally circular, solid cross-section, and may be tapered from one end of the extension 102 to the other. However, it is also possible for the extensions 102 to have a non-circular cross-section, such as an elliptical cross-section. Alternatively, the cross-section may be a polygon, such as triangle, rectangle, etc., or more complex shape, such as a cross, a crescent or a star. Further cross-sections of interest may effectively appear flat, such that the dimensions in one axis are at least 15 times those of the second axis. It is also possible for the cross-section to be hollow or tubular, instead of solid. Further, the extension 102 may have a nearly constant effective diameter from one end of the extension 102 to the other, or the effective diameter may vary in some fashion other than a taper.

Additionally, it is desirable to allow for multiple colors and goniometric properties of extensions which are applied to one set of lashes.

As to the effective diameter, a convention may be adopted where this characteristic is discussed relative to an effective diameter at a particular point along an extension, a maximum effective diameter of an extension, or an average of the effective diameters taken at a plurality of points along an extension, for example. Regardless of the convention adopted, a wide range of diameters may be used. For example, the extensions 102 may have an average effective diameter in the range of between about 0.01 mm and about 2.0 mm. According to other embodiments, the extensions 102 may have an average effective diameter in the range of between about 0.03 mm and about 1.0 mm. According to certain embodiments, the extensions 102 may have an average effective diameter in the range of between about 0.03 mm and about 0.70 mm.

As to the length (measured from end to end), a wide range of lengths may also be used. For example, the extensions 102 may have a length in the range of between about 1.0 mm and about 30.0 mm. According to other embodiments, the extensions 102 may have a length in the range of between about 2.0 mm and about 20.0 mm. According to certain embodiments, the extensions 102 may have a length in the range of between about 3.0 mm and about 15.0 mm.

As to the angle of curvature, there may also be a variety of conventions by which this is defined. As an example, one may discuss the angle of curvature in terms of the angle that is formed by the intersection of lines tangential to the ends of the extension. Again, a wide range may be used. For example, the extensions 102 may have an angle of curvature in the range of between about 3 and about 180 degrees. According to other embodiments, the extensions 102 may have an angle in the range of between about 30 and about 170 degrees. According to certain embodiments, the extensions 102 may have an angle in the range of between about 45 and about 160 degrees.

In regard to the backbone 104 and the closure 106, either may be in the form of a thin strip, fiber, etc. of material. Similar to the extensions 102, the backbone 104 and the closure 106 may be made of a biomaterial or a synthetic material. In fact, the backbone 104 and/or the closure 106 may be made of a material such that, after attachment of the extensions 102 to the user's eyelashes, the backbone 104 and/or the closure 106 may be dissolved or otherwise removed. In one embodiment, the backbone 104 and the closure 106 may be made of a water-soluble material, while the extensions 102 and an adhesive applied thereto to attach the extensions 102 to the eyelashes may be water-insoluble. For instance, after the backbone 104 and the closure 106 are used to place the extensions 102 relative to the eyelashes so that the extensions 102 may attach themselves to the eyelashes, water is applied to remove (dissolve) the backbone 104 and the closure 106. According to other embodiments, the backbone 104 and the closure 106 may be made of a more durable material, such that the backbone 104 and the closure 106 do not dissolve or otherwise disappear during normal use conditions.

The length of the backbone 104 and the closure 106, as manufactured, may vary according to the present disclosure. For example, the backbone 104 and the closure 106 may be manufactured in a length designed to provide coverage for users having an average eyelid length. Alternatively, the backbone 104 and closure 106 may be manufactured in lengths that are intended to be cut and/or trimmed by the user to be the exact length to provide a desired coverage, which may or may not coincide with the length of the user's eyelid. As a further alternative, the backbone 104 and the closure 106 may be manufactured in lengths shorter than would be expected to permit coverage from one end of an eyelid to the other. According to such an embodiment, two, three or more lengths of backbone 104 and closure 106 may be used to provide coverage for a single eyelid and associated eyelashes.

As to the density of the extensions, a large range of densities may be appropriate. Provided that the extensions 102 are attached to a backbone 104, the linear density of the individual extensions across the backbone is preferably about 5-150 extensions per linear cm of backbone. More preferably, the linear density of the extensions 102 is about 10-100 extensions per linear cm of backbone 104.

The mechanism of attachment between the extensions 102 and backbone 104 may vary according to the nature of the extensions 102 and the backbone 104, and the thickness of the backbone 104. For instance, if the thickness of the backbone 104 is sufficient, the extensions 102 may be disposed or embedded at least partially within the backbone 104. This may be achieved, for example, by molding the backbone 104 about ends of the extensions 102. Alternatively, if the thickness of the backbone 104 is not substantially greater than the effective diameter of the extensions 102, the extensions 102 may be attached to a surface of the backbone 104 using an adhesive compatible with the materials used to form the extensions 102 and the backbone 104. Still another means of attaching the extensions 102 to the backbone 104 is through a knot or braid. Additionally, for synthetic extensions 102 or backbones 104 a means of spot welding may be particularly effective through the use of heat or other means of creating a phase transformation with or without the use of pressure The mechanism of attachment between the eyelash extension system 100, or a part thereof, and the user's eyelashes may also vary. As mentioned above, an adhesive may be used. The adhesive may attach the surfaces 108, 110 together, thereby limiting removal of the eyelashes from between the surfaces 108, 110. The adhesive applied to one or both of the surfaces 108, 110 may also attach the eyelashes to one or both of the surfaces 108, 110, thereby further limiting removal of the eyelashes from between the surfaces 108, 110. Alternatively, the adhesive may be selected so as to attach the surfaces 108, 110 without attaching the eyelashes to either of the surfaces 108, 110. The selection of the adhesive may thus be influenced by the material used for the extensions 102, the backbone 104 and/or the closure 106, as well as the eyelashes. In this regard, it should be noted that the extensions 102, while intended for use with natural eyelashes as a replacement for false eyelashes, may be used with artificial eyelashes as well.

Adhesives may include, as non-limiting examples, latex adhesives, solvent-borne adhesives, pressure-sensitive adhesives (PSAs), and hot melt adhesives. Use of the latter type will require some degree of heating to occur at or near the time of application. In an embodiment wherein a two-part adhesive (like epoxy) is used, one component of the adhesive may be applied to one surface 108, 110 and the other component may be applied to the other surface 108, 110.

Another alternative may be to use a hook-and-loop attachment mechanism. For example, the hook material may be attached to one of the backbone surface 108 and the closure surface 110, while the loop material may be attached to the other of the backbone surface 108 and the closure surface 110. With the surfaces 108, 110 abutting each other, pressure applied to one or both of the backbone 104 and the closure 106 may encourage the entanglement of the hooks of the hook material in the loops of the loop material. It will be recognized that the hooks may instead be projections terminating in a button-shaped end, and the loops need not be closed. Other variations on the hook-and-loop attachment mechanisms will also be recognized as applicable to this embodiment.

Additionally, phase transition materials may be used as a mechanism of attachment. These phase change materials may transition between a fluid state and a solid or semi-solid state, wherein the fluid state may have varying degrees of viscosity. For instance, the material may be a wax, such as may be formed of fatty materials or synthetic hydrocarbons. In such a case, a wax backbone may define the attachment mechanism as well, and may disperse upon application of heat. Alternatively, the material may be a gel that swells with contact to fluid. The mechanism to prompt the phase change may also vary, and may include temperature, electromagnetic radiation, moisture, and ultrasonic vibrations. In regard to electromagnetic radiation, this is not limited to the visible light scale, but may include all wavelengths, such as infrared and ultraviolet.

As still another alternative, the backbone 104 and the closure 106 may be coupled to each other by magnetic fields. That is, the backbone 104 and the closure 106 may be coupled together, at least in part, by the magnetic force between two objects—such as between two magnets, or between a magnet and a material having a medium or higher magnetic permeability, such as iron. According to such an embodiment, the backbone 104, the closure 106 or both may be made in whole or in part of the material providing the magnetic coupling. That is, the backbone 104, for example, need not be made entirely of the material providing the magnetic coupling; instead, the backbone 104 may be made of a plastic material in which is embedded particles of the other material.

Figure 2:
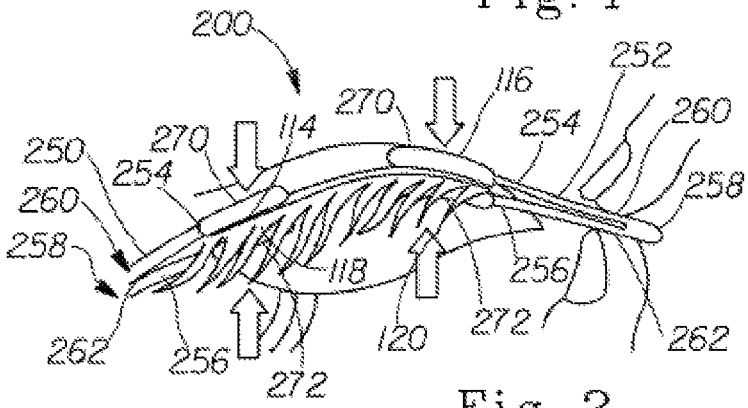
FIG. 2 is a perspective view of an eyelash extension applicator to be used with, for example, the eyelash extension system of FIG. 1, the applicator including a pair of clips.

FIG. 2 illustrates a first embodiment of an applicator 200 to be used with the system of FIG. 1, for example. The applicator 200 includes a pair of disposable clips 250, 252. Each of the clips 250 includes a first arm 254, a second arm 256, and a pivot 258 attached to the first arm 254 at a first end 260 and the second arm 256 at a second end 262. The pivots 258 may be in the form of a living hinge, as illustrated, or may have one or more elements. Further more, the pivots 258 may bias the arms 254, 256 relative to one state or another, as explained in greater detail below.

Each arm 254, 256 of each clip 250, 252 has a holder attached thereto. That is, the clip 250 includes a first holder 270 attached to the first arm 254 and attached to a first end 114 of the backbone 104, and a second holder 272 attached to the second arm 256 and attached to a first end 118 of the closure 106. Similarly, the clip 252 includes a first holder 270 attached to the first arm 254 and attached to a second end 116 of the backbone 104, and a second holder 272 attached to the second arm 256 and attached to a second end 120 of the closure 106.

The holders 270, 272 may be releasably attached to the backbone 104 and the closure 106 such that removal of the clips 250, 252 is possible after the clips 250, 252 have been used to position the system 100. The releasable attachment mechanism may be in the form of an adhesive with a lesser strength than is used to attach the backbone 104 to the closure 106, such that the force necessary to disengage the holders 270, 272 from the backbone 104 and the closure 106 is less than to disengage the backbone 104 form the closure 106. However, other attachment mechanisms may be possible, including mechanical fasteners, such as hook-and-loop by fasteners.

The arms 254, 256 are moveable about the pivots 258 between a first state, wherein the first and second arms 254, 256 are spaced relative to each other, and a second state wherein the first and second arms 254, 256 abut each other. The movement of the arms 254, 256 between the two states is illustrated through the inclusion of the pairs of arrows. As mentioned above, the pivots 258 may bias the arms 254, 256 toward one of the two states.

In operation, the arms 254, 256 are attached at their respective holders 270, 272 to the backbone 104 and the closure 106. This may be done by the manufacturer of the system 100, or by the user prior to application. The arms 254, 256 are initially maintained in a spaced relationship to each other. The applicator 200 is then positioned relative to the user's eyelashes such that the eyelashes depend through the space 112 between the backbone 104 and the closure 106. In this position, one, both or neither of the backbone 104 and the closure 106 may be resting against a surface of the eyelashes.

A force may then be applied to one or both of the arms 254, 256 to move the arms 254, 256 toward each other to achieve the state illustrated in FIG. 2. With the arms 254, 256 in abutment, at least partially, the backbone 104 and the closure 106 are brought together with the user's eyelashes supported therebetween. A force may be applied to the backbone 104 and the closure 106 to ensure that the backbone 104 and the closure 106 are attached to each other, after which a force may be applied to the arms 254, 256 of the clips 250, 252 to disengage the backbone 104 and the closure 106 from the holders 270, 272. The clips may be disposed of immediately, or may be retained for additional uses.

Figure 3A:
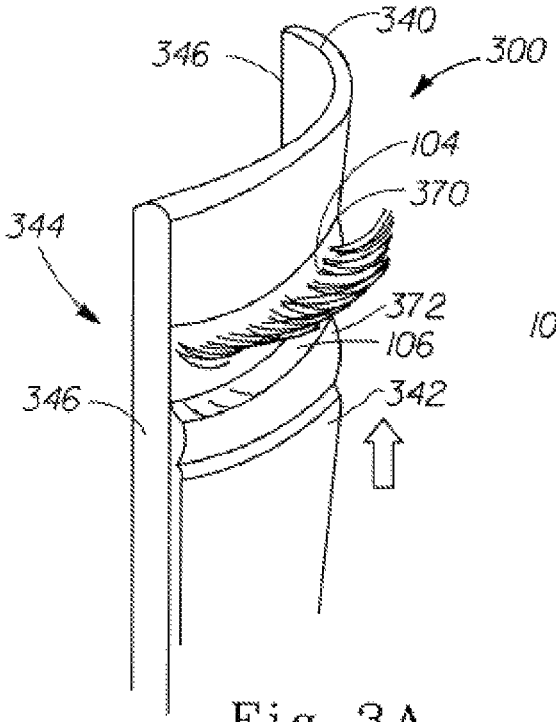
FIG. 3A is a perspective view of an eyelash extension applicator to be used with, for example, the eyelash extension system of FIG. 1, the applicator including a translating carrier in an open state.
Figure 3B:
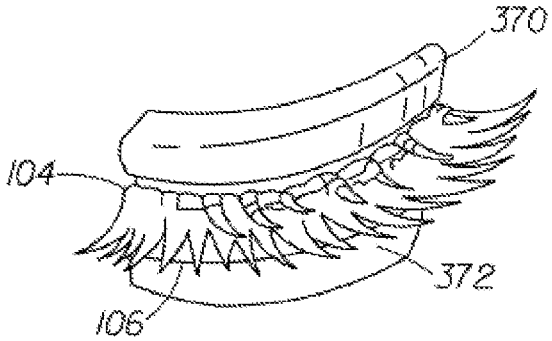
FIG. 3B is a partial, enlarged perspective view of the applicator of FIG. 3A with the translating carrier in a closed state.

FIGS. 3A and 3B illustrate another applicator 300 which may be used with the system 100. The applicator 300 includes a frame 340 and a carrier 342. The frame 340 has a track 344 attached thereto, which attachment may in certain instances include having the track 344 formed integrally with the frame 340. As illustrated in FIG. 3A, the track 344 includes a pair of spaced rails 346. As represented by the arrow in FIG. 3A, the carrier 342 is moveably mounted to the track 344 for movement along the track 344 between a first position, illustrated in FIG. 3A, and a second position, illustrated in FIG. 3B. To mount the carrier 342 to the track 344, the carrier 342 may have sides that are received in the rails 346, which may have a U-shape, or may have sides that surround, at least partially, the tracks 346.

Similar to the clips 250, 252 of the applicator 200 in FIG. 2, the applicator 300 includes a first holder 370 and a second holder 372. As illustrated, the first holder 370 is mounted to the frame 340, and the second holder 372 is mounted to the carrier 342. Given that the frame 340 and the carrier 342 have first and second states wherein the frame 340 and the carrier 342 are spaced and then brought together, consequently the holders 370, 372 are spaced apart with the carrier 342 in a first position and abut with the carrier 342 in a second position. With the holders 370, 372 being brought together, the backbone 104 and closure 106 mounted to the holders 370, 372 would also be brought together as well.

The holders 370, 372 are intended to releasably attach one of the backbone 104 and the closure 106. As illustrated, the holder 370 is attached to the backbone 104 and the holder 372 is attached to the closure 106. It will be recognized that the orientation of the applicator 300 may be reversed, such that the holder 370 is attached to the closure 106 and the holder 372 is attached to the backbone 104. For that matter, the lower portion of the applicator 300 may define the frame 340 to which the track 346 is attached, and the upper portion of the applicator 300 may define the carrier 342. It will also be recognized that rather than applying the force to the lower portion of the applicator 300 relative to the upper portion of the applicator 300, the force may be applied to the upper portion of the applicator 300 instead.

The applicator 300 may also be used with systems other than the system 100 illustrated in FIG. 1. For instance, an alternative system 400 is illustrated in FIGS. 4A-4C, which system 400 may be used in combination with the applicator 300.

Figure 4A:
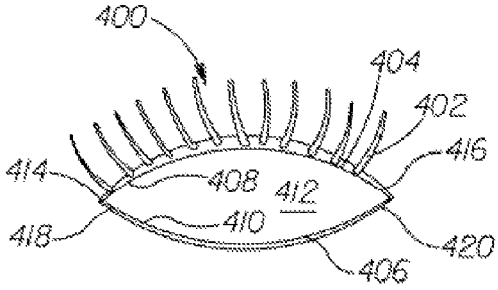
FIG. 4A is a perspective view of another eyelash extension system to be applied to a set of eyelashes, the system being in an open state.
Figure 4B:
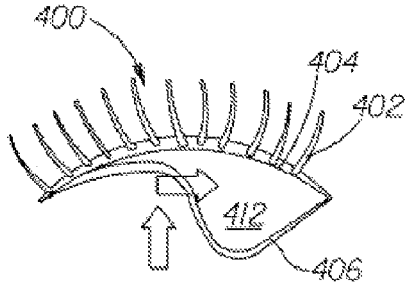
FIG. 4B is a perspective view of the system of FIG. 4A in an intermediate state.
Figure 4C:
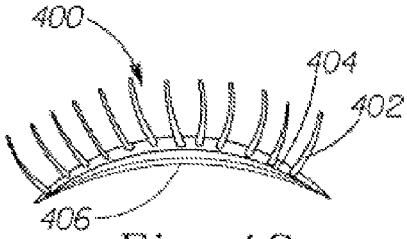
FIG. 4C is a perspective view of the system of FIG. 4A in a closed state.

FIGS. 4A-C illustrate a system 400 including a set of eyelash extensions 402 that are attached to a backbone 404. The system 400 also includes a closure 406. The backbone 404 has a backbone surface 408, and the closure 406 has a closure surface 410. The surfaces 408, 410 define a space 412 therebetween for the insertion of a user's eyelashes. The closure has a first state (FIG. 4A) wherein the surfaces 408, 410 are spaced, and a second state (FIG. 4C) wherein the surfaces 408, 410 abut.

However, unlike the system 100, the backbone 404 and closure 406 are attached to each other even in the first state. In particular, the strip-like backbone 404 has opposed, spaced ends 414, 416, and the strip-like closure 406 has opposed, spaced ends 418, 420. The ends 414, 418 are attached together, as are the ends 416, 420. According to one embodiment, the ends 414, 418 and 416, 420 are in the form of a pair of living hinges, although it will be recognized that the backbone 404 and the closure 406 may be separate pieces that are attached by some other mechanism at the ends 414, 416, 418, 420.

In use, force is applied to the closure 406 to change the concavity of the closure surface 410, and in the process move the surfaces 408, 410 into abutment. That is, as a tool or finger is applied against or along the closure 406, the shape of the closure surface 410 changes from concave to convex, with the closure surface 410 moving toward the backbone surface 408 (which is concave in shape). As the movement continues, from FIG. 4A to FIG. 4B to FIG. 4C, eyelashes initially disposed in the space 412 between the surfaces 408, 410 become trapped between the surfaces 408, 410, with their removal from the space 412 being limited as a consequence. It will be recognized that adhesive or another attachment mechanism may be used as well to further limit removal of the eyelashes from between the surfaces 408, 410.

It will be recognized that the applicator 300 may provide the necessary force to move the backbone 404 and closure 406 relative to each other. That is, the backbone 404 of such a system may be placed in the holder 370, while the closure 406 is placed in the holder 372. Upward movement of the carrier 342 relative to the frame 340 would cause the movement of the closure 406 relative to the backbone 404. The shape of the carrier 342, and the holder 372 in particular, may be modified to assist in the process, by having a shape complementary to the backbone surface 408, for example.

Figure 5A:
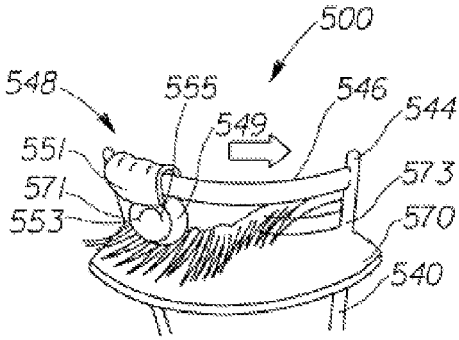
FIG. 5A is a perspective view of an eyelash extension applicator to be used with, for example, the eyelash extension system of FIGS. 4A-C, the applicator including a cam in a first position.
Figure 5B:
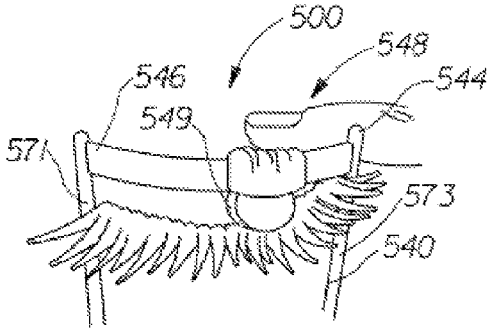
FIG. 5B is a perspective view of the applicator of FIG. 5A with the cam in a second position spaced laterally from the first position.

Alternatively, the system 400 may be used with an applicator 500 such as is illustrated in FIGS. 5A and 5B. The applicator is similar to that of FIGS. 3A and 3B in that it includes a frame 540 and a moveable element that is moveably mounted to a track 544 having a rail 546 attached to the frame 540. Also, the illustrated applicators 300, 500 share another commonality in that the moveable element moves in a plane defined by the track 344, 544. It will be recognized that this may not be true for all embodiments of the applicator 300, 500. Where the applicators 300, 500 differentiate is in regard to the relative motion of the moveable element to the frame, and in regard to an eyelash extension system disposed in a holder attached to the frame.

As seen in FIG. 5A, the applicator 500 includes a cam 548 that is moveable along the rail 546 in a direction orthogonal to that produced by the applicator 300. That is, the holder 570 has a first end 571 and a second end 573. The cam 548 moves along the rail 546 between the ends 571, 573 of the holder 570, from the first end 571 to the second end 573, for example. As the cam 548 moves between the ends 571, 573 of the holder 570, a cam surface 549 of the cam 548 moves relative to the holder 570 to cooperate with a system positioned in the holder 570.

While the cam surface 549 may move with the cam 548 relative to the frame 540, it is also possible that the cam surface 549 moves relative to the remainder of the cam 548. In regard to the embodiment illustrated, the cam 548 includes a shoe 551 that moves along the rail 546 and a pin 553 attached to the shoe 551. A roller 555 is pivotally mounted to the pin 553, and has an outer surface that defines the cam surface 549. As the shoe 551 is moved along track 546, the cam surface 549 is caused to move about an axis defined by the pin 553. Thus, the cam surface 549 moves relative to the frame 540 and the remainder of the cam 548.

It will be recognized that by placing a system 400 in the holder 570, the backbone 404 may be advantageously brought into contact with the closure 406 with a motion that is side to side relative to the system 400, rather than up and down. This motion may better ensure that the surfaces 408, 410 of the backbone 404 and closure 406 are brought into contact as the cam surface 549 moves relative to the frame 540.

Figure 6:
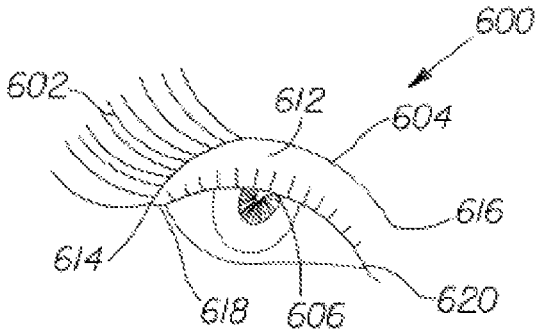
FIG. 6 is a perspective view of still another eyelash extension system to be applied to a set of eyelashes, the system being in an open state.

FIG. 6 illustrates another system 600, wherein a backbone 604 and closure 606 are attached at one end, but not both ends. Rather, the backbone 604 has ends 614, 616; the closure has ends 618, 620; and only the ends 614, 618 are attached. Ends 616, 620 are not attached, and may be instead initially spaced from each other in the first state of the closure 606, although the ends 616, 620 may abut in the second state of the closure 606. The closure 606 may be maintained in the second state through the action of the hinge formed by the attached ends 614, 618, or the closure 606 may be maintained in the second state through the use of an adhesive in combination or in substitution for the action of the hinge. The backbone 604 and closure 606 define a space 612 wherein eyelashes may be disposed.

Figure 7A:
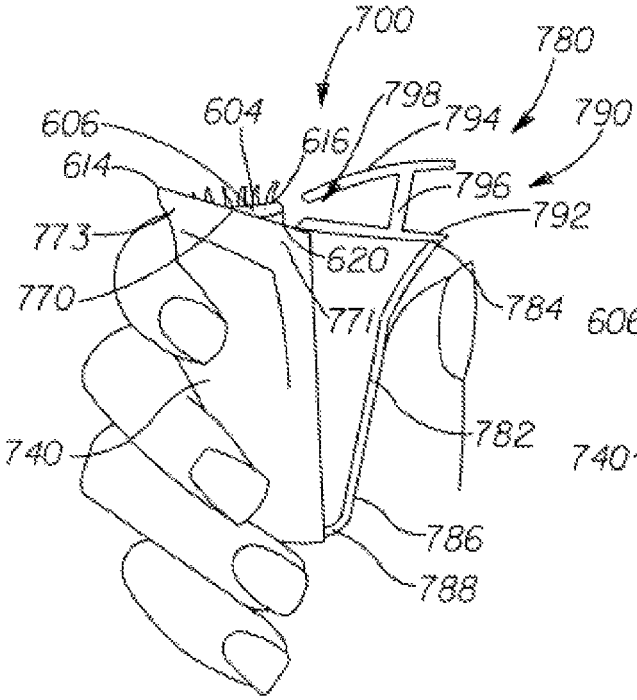
FIG. 7A is a perspective view of an eyelash extension applicator to be used with, for example, the eyelash extension system of FIG. 6, the applicator including a tool with an angled, open wedge.
Figure 7B:
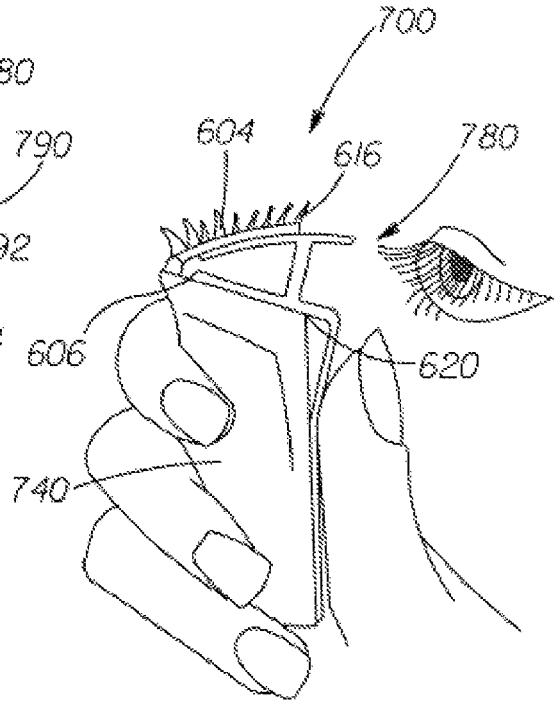
FIG. 7B is a perspective view of the applicator of FIG. 7A with the angled, open wedge in the system so as to space the backbone from the closure.

Depending on the manner in which the system 600 is initially biased, such a system 600 may be advantageously used with the applicator 500. That is, if the system 600 is initially biased at the ends 614, 618 to have an open profile, such as is shown in FIG. 6, then use of the applicator 500 may advantageously be used to close the system 600 as the cam surface 549 moves along the holder 570 in a side-to-side motion. However, it may be preferred to have the system 600 initially biased to a closed profile, and to this end a further applicator 700 is illustrated in FIGS. 7A and 7B.

The applicator 700 includes a frame 740 and a tool 780 moveably mounted to the frame for movement relative to the frame 740. It will be recognized that any number of mechanisms may be used to mount the tool 780 to the frame 740. As illustrated, however, the tool 780 is mounted on an arm 782 with a first end 784 attached to the tool 780 and a second end 786 pivotally attached to the frame 740. While the pivotal attachment is in the form of a living hinge 788, as illustrated, it will be recognized that other multi-part hinges, pivots, and/or linkages may be used as well. The tool 780 is able to move relative to the frame 740 from a first position, illustrated in FIG. 7A, and a second position, illustrated in FIG. 7B.

The frame 740 has a holder 770 mounted thereon. The holder 770 has a first end 771 and a second end 773 spaced laterally from the first end 771. As the tool 780 moves from the position illustrated in FIG. 7A to that illustrated in FIG. 7B, the tool 780 moves from the first end 771 to the second end 773 of the holder 770.

The tool 780 includes a wedge 790. The wedge 790 has a base 792 and a sloping angle 794 that are joined by a beam 796. The base 792 and the angle 794 meet in an open point 798, which point is open in the directions of the base 792 and the angle 794.

In operation, as the tool 780 is moved toward the first end 771 of the holder 770, the wedge 790 contacts a system 600 disposed in the holder 770. In particular, the wedge 790 contacts the system 600 at the ends 616, 620. Movement of the tool 780 in the direction of the second end 773 causes the wedge 790 to separate the backbone 604 relative to the closure 606, and the backbone 604 to advance along the angle 794. The motion of the tool 780 stops at the second end 773 of the holder 770, at which point the backbone 604 and the closure 606 are sufficiently spaced to permit the user to insert eyelashes into the space adjoining the open point 798 (see FIG. 7B). The open point 798 permits the user to position the eyelashes as closed to the joined ends 614, 616 of the system 600 as is desired. As the tool 780 is withdrawn toward the first end 771, the backbone 604 and closure 606 come together, limiting the removal of the eyelashes from between the surfaces 608, 610 of the backbone 604 and closure 606.

While the foregoing illustrations have featured an eyelash extension system with a backbone and closure, it will be recognized that according to certain embodiments of the present disclosure, it is not required to have both a backbone and a closure. That is, the eyelash extensions may be releasably attached to a backbone, and transferred with or from the backbone to the eyelashes without the use of a closure. In fact, it may even be possible, according to certain embodiments explained in greater detail below, to have a system wherein the eyelashes are not attached to a backbone or closure.

Figure 8:
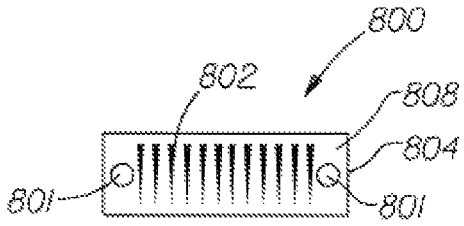
FIG. 8 is a plan view of another eyelash extension system to be applied to a set of eyelashes.

FIG. 8 illustrates an embodiment of a system 800 including a backbone 804, but no closure. Eyelash extensions 802 are attached to the backbone 804, and in particular a backbone surface 808, using one of the many mechanisms or methods described above. The mechanism used to attach the extension 802 to the surface 808 may vary in accordance with the intended use of the system 800. That is, if the intent is for the backbone 804 to adhere to the user's eyelashes, then the extensions 802 may be more securely or fixedly attached to the backbone 804. However, according to other embodiments, a similarly formed system 800 may be used to transfer the extensions 802 to the eyelashes without the backbone 804, in which case the extensions may be releasably attached to the backbone 804.

The system 800 may also include fittings 801. The fittings 801 are used to attach the system 800 to an applicator. As explained in greater detail below, the system 800 is supported without a structure immediately or directly beneath the backbone 804 by attaching the system 800 via the fittings 801 to the applicator. The system 800 is thus suspended from the fittings 801 like a bridge or hammock.

It will be recognized that while the system 800 includes two such fittings 801, the system 800 could include other numbers of fittings according to other embodiments of the disclosure. The system 800 could even include a single fitting, the system 800 being cantilevered from the fitting. The material of the backbone 804 may vary according to the number of fittings used, as it will be understood that a system 800 that is intended to be cantilevered may require a stiffer material than an embodiment that is suspended between two or more fittings.

Figure 9A:
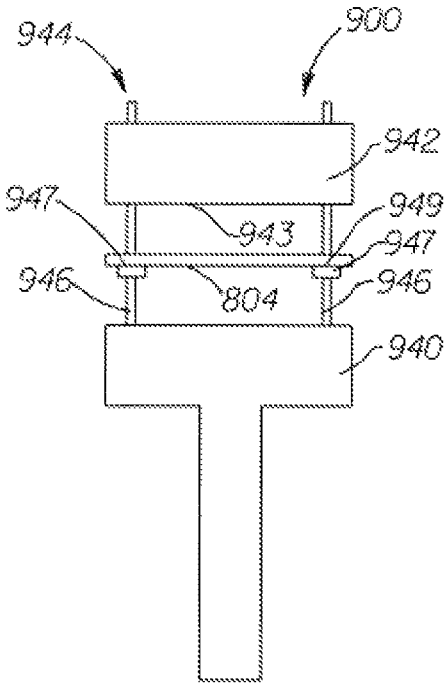
FIG. 9A is a side view of an eyelash extension applicator to be used with, for example, the eyelash extension system of FIG. 8, the applicator including a press in an open state.
Figure 9B:
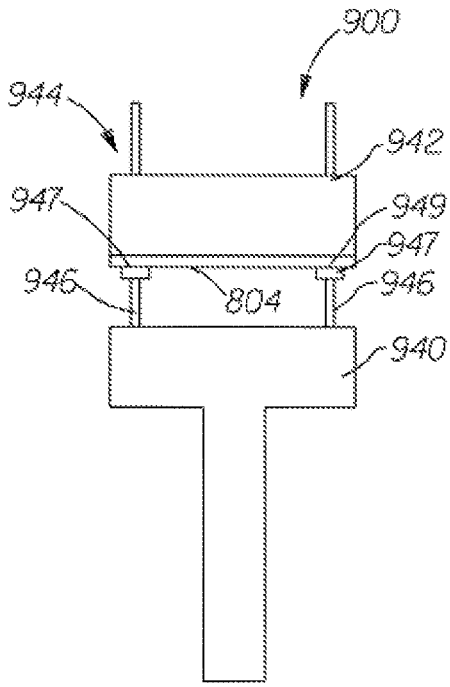
FIG. 9B is a side view of the applicator of FIG. 9A with the press in a closed state.
Figure 10:
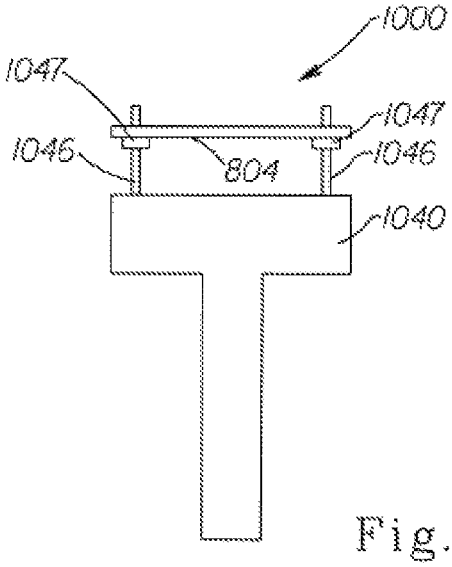
FIG. 10 is a side view of another eyelash extension applicator to be used with, for example, the eyelash extension system of FIG. 8.

Two applicators 900, 1000 are illustrated in FIGS. 9A-B and 10 for use with the system 800, although the applicators illustrated in FIGS. 3A-B and 5A-B could be used as well with the system 500. Both applicators 900, 1000 include opposing structures that cooperate with the fittings 801 to suspend the system 800 therebetween. However, the applicator 900 includes an additional mechanism for applying force to the eyelashes and the system 800, while the applicator 1000 lacks this mechanism.

Turning first then to the applicator 900, the applicator includes a frame 940 and a moveable press 942. The frame 940 includes a track 944 attached thereto, the track 944 including a pair of rails 946. The rails 946 may be in the form of one or more rod-like structures having a cross-section that is complementary to or mates with the cross-section of the fittings 801 of the system 800. However, according to other embodiments, it is possible for the rails 946 to differ in cross-section relative to the fittings 801. Stops 947 may be attached to the rails 946 at a relatively equal distance along the rails 946, and define a shoulder 949 against which the system 800, and in particular the backbone 804 and/or fittings 801 may abut. The movement of the press 942 may also be inhibited in a first direction by the stops 947. Instead of stops 947, the rails 946 may be tapered to inhibit movement of the system 800 or the press 942 beyond a certain point in the first direction.

To prepare the applicator 900 for use, the press 942 is removed from the rails 946, and the system 800 is placed on the track 944 with each of the rails 946 being received in one of the fittings 801. The system 800, and in particular the backbone 804, is then advanced in the first direction until the backbone 804 and/or fittings 801 abut the stops 947. It will be recognized that with the backbone 804 and/or fittings 801 abutting the stops 947, the backbone 804 is suspended above a surface of the frame 940, without support immediately or directly beneath the backbone 804. The press 942 is then replaced on the rails 946, and the applicator 900 is ready for use.

In use, the applicator 900 is advanced towards the eye with the applicator 900 in the open state illustrated in FIG. 9A. In this state, the press 942 is spaced from the surface 808 of the backbone 804 such that the user may dispose their eyelashes within the space thus formed. The user then places the eyelashes in the space, and brings the eyelashes down against the backbone 804. The press 942 is then advanced along the track 944 in the first direction to apply a force against the backbone 804. The force applied by the press 942 to the backbone 804 may assist in adhering the backbone 804 and/or the eyelash extensions 802 to the eyelashes.

Depending on the system 800, the eyelash extensions 802 may then be removed from the applicator, with or without the backbone 804. For example, according to certain embodiments, the eyelash extensions 802 may be releasably attached to the backbone 804, such that once the press 942 is moved in a second direction opposite the first direction, the eyelashes with eyelash extensions 802 may be removed and the backbone 804 removed and discarded. According to other embodiments, the backbone 804 may also be attached to the eyelashes. According to such an embodiment, the region of the backbone 804 attached to the eyelashes may be separated from the region of the backbone 804 that includes the fittings 801. For example, the system 800 may be removed from the applicator 900, and then the fittings 801 may be removed by hand, through the use of a tool, like scissors, or the backbone 804 may be formed with a weakened section or divider, permitting the region of the backbone 804 including the fittings 801 to be torn off. The weakened section may be formed through the use of scoring or perforations, for example.

Where a weakened section is provided, it may also be possible to define the shape of the press 942 so that the surface 943 may advance through the plane defined by the backbone 804 in the first direction. In doing so, the press 942 may apply a force to the region of the backbone between the weakened sections. The force applied via the press 942 may, according to such an embodiment, shear off the regions of the backbone 804 including the fittings 801. It will be recognized that if the edges of the surface 943 are sharpened, it may not be necessary to define weakened sections on the backbone 804 for the press 942 to separate the different regions of the backbone 804.

FIG. 10 illustrates a variant on the applicator 900. According to the applicator 1000, no press is included. Instead, the applicator 1000 includes a frame 1040 with side pieces 1046 attached. Stops 1047 are positioned on the side pieces 1046, and the fittings 801 cooperate with the side pieces 1046 such that the system 800 is suspended between the side pieces 1046. Because a press is not included, the user may have to manually apply pressure to the eyelashes to ensure proper attachment between the eyelashes and the eyelash extensions 802 and/or the backbone 804. Otherwise, the operation of the system (e.g., separation of the eyelash extensions 802 from the backbone 804, or separation of the regions of the backbone 804) is similar to that discussed above relative to applicator 900.

Figure 11A:
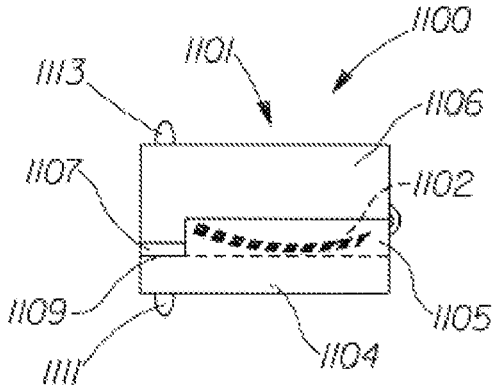
FIG. 11A is a side view of an eyelash extension system in a closed state.
Figure 11B:
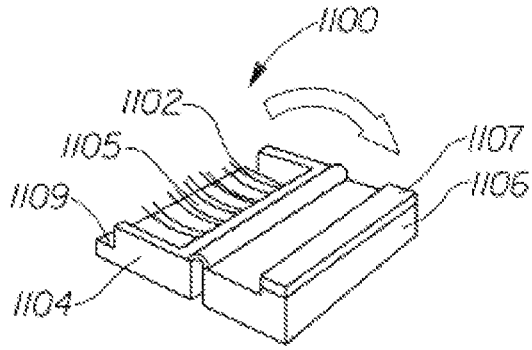
FIG. 11B is a perspective view of the eyelash extension system of FIG. 11A in an open state.

As noted above, it may even be possible to define an eyelash extension system that does not have the eyelash extensions attached to a backbone. One such system is illustrated in FIGS. 11A and 11B, with an applicator for this system illustrated in FIGS. 12A-B and 13A-B.

The system 1100 includes a plurality of eyelash extensions 1102. However, rather than a backbone and closure, the system 1100 includes a hinged box 1101 with a first section 1104 and a second section 1106.

The first section 1104 includes a holder 1105 in which the eyelash extensions 1102 are disposed. The eyelash extensions 1102 may be disposed in the holder 1105 in a particular orientation, and may be releasably attached to the holder 1105 in that orientation. However, it may also be that the eyelash extensions 1102 are not attached to the holder 1105. In fact, the holder 1105 may include a plurality of grooves, each of the eyelash extensions 1102 disposed in one of the plurality of grooves.

The second section 1106 includes a strip of adhesive 1107. The strip of adhesive 1107 is selected to transfer adhesive to the eyelashes and/or eyelash extensions 1102 disposed within the system 1100, and to attach the eyelashes to the eyelash extensions 1102. To this end, the opposing surface 1109 of the first section 1104 may be treated with a surface coating to prevent the adhesive strip 1107 from securing the two sections 1104, 1106 of the box 1101 together. Alternatively, a release paper may be attached to the surface 1109 to limit or prevent adherence of the two sections 1104, 1106 together.

The system 1100 includes connectors 1111, 1113 that cooperate with the applicator 1200 illustrated in FIGS. 12A-B and 13A-B to position the system 1100 relative to the applicator 1111, 1113. The connectors 1111, 1113 may include a variety of mechanisms. As illustrated, the connectors 1111, 1113 may be hemispherical knobs that are received in mating structures of the applicator. A friction fit, for example, may be formed to attach the system 1100 to the applicator 1200. Alternatively, the connectors 1111, 1113 may simply limit the movement of the system 1100 relative to the applicator 1200 without any attachment of the system 1100 and the applicator 1200.

Figure 12A:
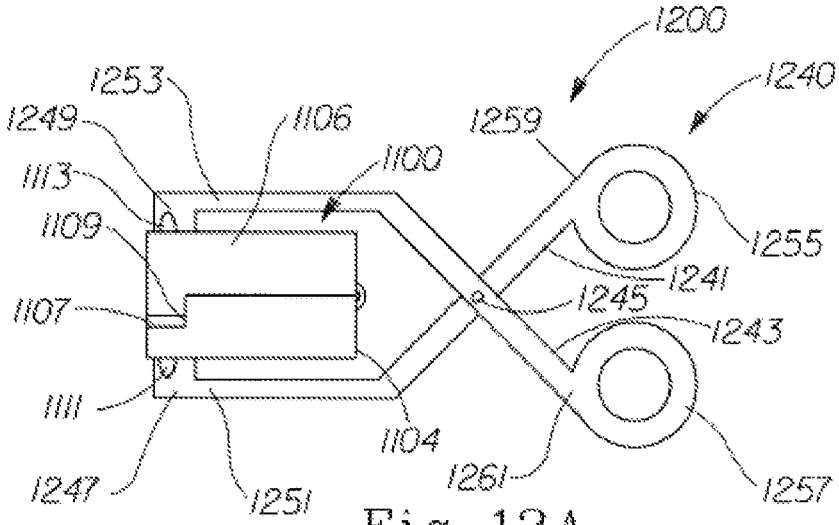
FIG. 12A is a side view of an eyelash extension applicator to be used with, for example, the eyelash extension system of FIG. 11A, the applicator disposed so that the eyelash extension system is in a closed state.
Figure 12B:
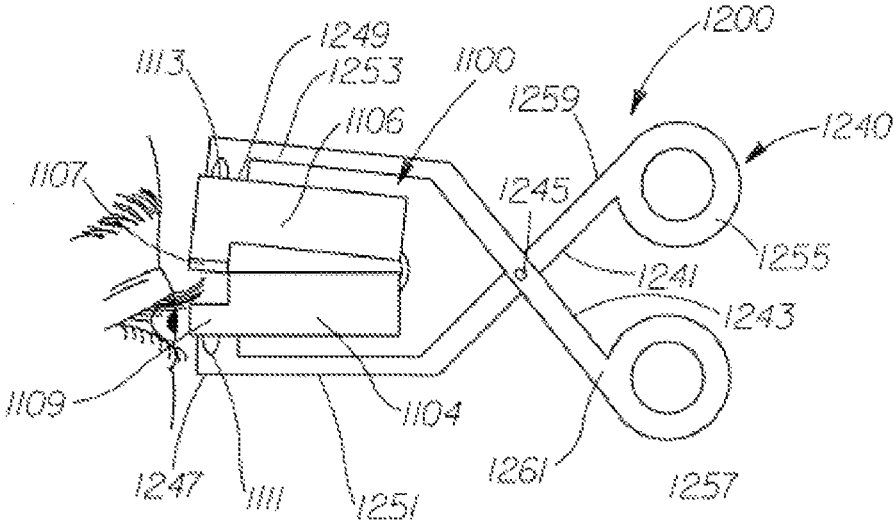
FIG. 12B is a side view of the applicator of FIG. 12A with the applicator holding the eyelash extension system in an open state.

Turning now to the applicator 1200 pictured in FIGS. 12A-B, the applicator 1200 includes a scissor-like frame 1240, with a first leg 1241 and a second leg 1243 joined along their length by a pin 1245. Each leg 1241, 1243 may have a connector 1247, 1249 disposed at one end 1251, 1253 of the leg 1241, 1243, and a finger grip 1255, 1257 disposed at the other end 1259, 1261 of the leg 1241, 1243. The connectors 1247, 1249 may positively attach the system 1100 to the applicator 1200, or may simply cooperate to limit the movement of the system 1100 relative to the applicator 1200. Movement of the finger grips 1255, 1257 towards each other and away from each other causes movement of the ends 1251, 1253, which movement may be transferred to the first and section sections 1104, 1106 of the system 1100.

As seen in FIG. 12A, the system 1100 is in a first state with the eyelash extensions 1102 disposed between the first and second sections 1104, 1106. The box 1101 may include a latch that keeps the first and second sections 1104, 1106 in this first state until the time of application. The system 1100 is positioned relative to the applicator 1200 so that the connectors 1111, 1113 may cooperate with the connectors 1247, 1249. According to the embodiments illustrated, the connectors 1111, 1113, 1247, 1249 form a positive connection, such that movement of the ends 1251, 1253 is transferred to the sections 1104, 1106.

As seen in FIG. 12B, the finger grips 1255, 1257 have been moved away from each other, such that the ends 1251, 1253 are further spaced from each other than is illustrated in FIG. 12A. The movement of the ends 1251, 1253 away from each other causes the section 1106 to move relative to the section 1104, permitting access to the interior of the box 1101. As is illustrated, the system 1100 may then be advanced toward the eyelashes, so that the eyelashes advance at least as far into the box 1101 so as to be disposed between the surfaces 1107, 1109 when the system 1100 and applicator 1200 are returned to the state illustrated in FIG. 12A.

Figure 13A:
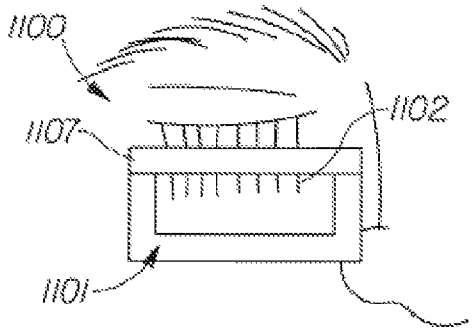
FIG. 13A is a partial, cross-sectional view of the eyelash extension system of FIG. 11A in a closed state, with the eyelashes disposed between opposing surfaces of the system.
Figure 13B:
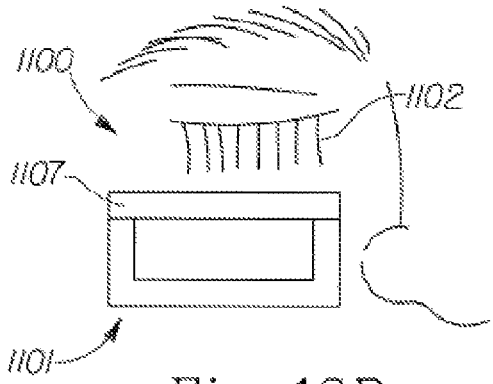
FIG. 13B is a partial, cross-sectional view of the eyelash extension system of FIG. 11A in a closed state, with the box spaced from the eyelashes and the extensions attached to the eyelashes.

FIG. 13A illustrates a top-down view of the system 1100 after the system 1100 has been returned to the state illustrated in FIG. 12A. The eyelashes have been brought into contact with the eyelash extensions 1102 and the adhesive strip 1107, thereby attaching the eyelashes to the eyelash extensions 1102. Movement of the system 1100 between the state illustrated in FIG. 13A to that of FIG. 13B results in the eyelashes and the attached eyelash extensions 1102 being withdrawn from the box 1101. The box 1101 may be removed from the applicator 1200, and the box 1101 may be discarded.

Figure 14:
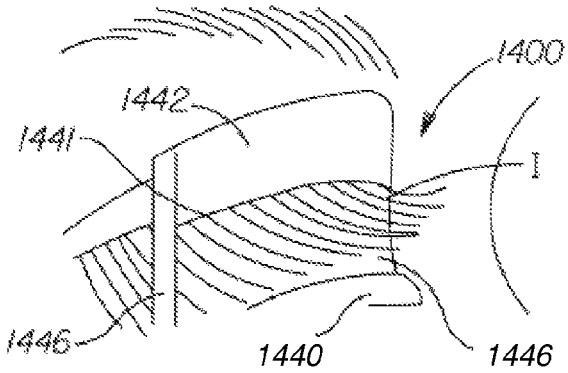
FIG. 14 is a perspective view of an eyelash extension applicator including a light source.
Figure 15A:
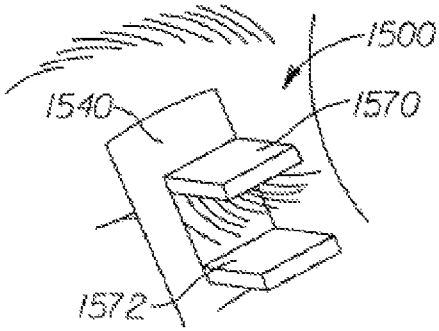
FIG. 15A is a perspective view of an eyelash extension applicator wherein surfaces of the applicator are mirrored.
Figure 15B:
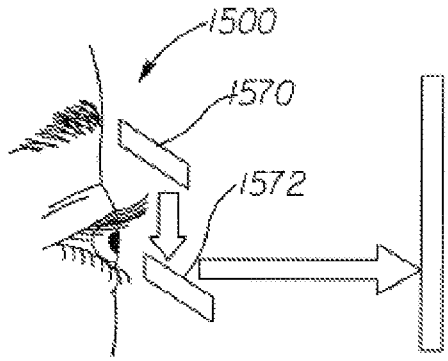
FIG. 15B is a schematic view of the eyelash extension applicator of FIG. 15A, in combination with an additional mirrored surface.

It will be recognized that one or more of the applicators previously described may benefit from the addition of a device or mechanism for visualizing the placement of the eyelash extension system relative to the user's eyelashes. Two such visualization systems are illustrated in FIGS. 14 and 15A-B. These systems are illustrated relative to a system similar to that illustrated in FIGS. 3A and 3B or 9A and 9B, for example. However, it will be recognized that the devices and mechanisms of FIGS. 14 and 15A-B may be used with any of the applicators described herein. Moreover, it will be recognized that the mechanism illustrated in FIG. 14 may be used in conjunction with the mechanism of FIGS. 15A and 15B.

As illustrated in FIG. 14, the applicator 1400 includes a lower piece 1440 and an upper piece 1442. The lower and upper pieces 1440, 1442 are attached using two side pieces 1446. The upper piece 1442 may move along the side pieces 1446 between a first state wherein the lower and upper pieces 1440, 1442 are spaced and a second state wherein the lower and upper pieces 1440, 1442 abut, or vice versa. Alternatively, the upper piece 1442 may be fixedly attached to the side pieces 1446 such that limited or no movement occurs between the lower and upper pieces 1440, 1442.

Attached to the upper piece 1442 are one or more light sources 1441. The light source 1441 directs light in the direction of the lower piece 1440, thereby illuminating a section of the eyelash or eyelash extension, as indicated by I in FIG. 14. The illumination of the eyelash and or eyelash extension may provide a visual indication to the user regarding the relative positioning of the applicator 1400 relative to the user's eyelashes. The visual indication may improve the user's ability to align the eyelashes and the eyelash extensions or applicator 1400. Alternatively, the light source may simply be used to increase the visibility of the eyelashes and the eyelash extension system.

The light source 1441 may be defined by using light emitting diodes, or LEDs, for example, in which case a power source for the light source and switch to turn the light source 1441 on or off may be included. Alternatively, miniature light bulbs may be used in place of the LEDs. As a further alternative, a chemical light source may be used, wherein the light source is activated by rupturing a frangible separation or divider to permit two components to mix, which components, when mixed, provide light via luminescence. Other alternatives will also be recognized.

FIGS. 15A and 15B illustrate an applicator 1500 wherein facing surfaces of the applicator 1500 are mirrored, so as to provide a system of mirrors permitting visualization of the eyelashes and/or eyelash extensions. The applicator 1500 includes a frame 1540 with an upper piece 1570 and a lower piece 1572. Each of the pieces 1570, 1572 has a mirrored surface so that light may reflect off of the surface of the pieces 1570, 1572, permitting visualization of the placement of the eyelashes below the upper piece 1570. The reflection of the image from the surface of the upper piece 1570 may be further reflected off of the lower piece 1572, and on to a separate mirror facing the user, as is illustrated in FIG. 15B.

The upper piece 1570 may also serve as a holder for an eyelash extension system, as may the lower piece 1572. Alternatively, the backbone may be suspended between the pieces 1570, 1572 as illustrated in FIGS. 9A and 9B. It will be recognized that if the backbone of an eyelash extension system is to be disposed on either of the pieces 1570, 1572 or between the pieces 1570, 1572, then it may advantageous for the backbone to be made of a transparent material.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An applicator for use with an eyelash extension system comprising a backbone having a backbone surface, a plurality of eyelash extensions attached to the backbone and depending therefrom, a closure having a closure surface facing the backbone surface and configured to be joined thereto, the applicator comprising:

a frame having a first end and a second end spaced laterally from the first end;

a rail attached to the frame and extending laterally between the first and second ends; and a cam comprising a cam surface, the cam surface being configured to contact the backbone when the applicator is used with the eyelash extension system, the cam being movably joined to the rail such that the cam can be moved along the rail from the first end to the second end thereby causing the cam surface to urge the backbone to come into contact with the closure.

2. An applicator for use with an eyelash extension system comprising a backbone having first and second backbone ends and a backbone surface extending between the first and second backbone ends, a plurality of eyelash extensions attached to the backbone and depending therefrom, and a closure having first and second closure ends and a closure surface extending between the first and second closure ends, wherein the first closure end is attached to the first backbone end, and the second closure end is not attached to the second backbone end, the applicator comprising:

a frame having a holder configured to hold the eyelash extension system, wherein the holder has a first holder end and a second holder end spaced laterally therefrom; and a wedge moveably mounted to the frame and configured to separate the backbone from the closure as the wedge moves.

3. The applicator of claim 2, wherein the first closure end is attached to the first backbone end by a hinge.

4. The applicator of claim 2, wherein the eyelash extension system is initially biased to a closed profile such that the backbone surface is in contact with the closure surface.

5. The applicator of claim 2, wherein the wedge is pivotally attached to the frame.

6. The applicator of claim 5, wherein the wedge is pivotally attached to the frame by a living hinge.

7. The applicator of claim 2, wherein the wedge includes a base and a sloping angle.

8. The applicator of claim 7, wherein the base and the sloping angle meet in an open point.

9. The applicator of claim 8, wherein the open point is in communication with an interior space between the base and the sloping angle.

10. The applicator of claim 8, wherein the base and the sloping angle are joined by a beam.

11. The applicator of claim 8, wherein the wedge is configured to separate the backbone from the closure as the wedge moves between a first position wherein the open point is aligned with the first holder end and a second position wherein the open point is aligned with the second holder end.

12. The applicator of claim 1, wherein the cam includes a shoe that is configured to move along the rail, a pin attached to the shoe, and a roller that is pivotally mounted to the pin.

13. The applicator of claim 1, wherein the cam is configured to move in a plane.

14. The applicator of claim 1, wherein the cam is configured to move side to side relative to the eyelash extension system.

* * * * *